US011096860B2

(12) United States Patent
DiPeri et al.

(10) Patent No.: US 11,096,860 B2
(45) Date of Patent: Aug. 24, 2021

(54) ELECTROMECHANICAL SPHERICAL MASSAGE IMPLEMENT

(71) Applicants: Jonothan DiPeri, Springville, UT (US); Jonathan Blotter, Heber City, UT (US)

(72) Inventors: Jonothan DiPeri, Springville, UT (US); Jonathan Blotter, Heber City, UT (US)

( * ) Notice: Subject to any disclaimer, the term of this patent is extended or adjusted under 35 U.S.C. 154(b) by 306 days.

(21) Appl. No.: 16/382,180

(22) Filed: Apr. 11, 2019

(65) Prior Publication Data

US 2019/0314240 A1 Oct. 17, 2019

Related U.S. Application Data

(60) Provisional application No. 62/655,814, filed on Apr. 11, 2018.

(51) Int. Cl.

| | |
|---|---|
| ***A61H 15/00*** | (2006.01) |
| ***A61H 15/02*** | (2006.01) |
| ***A61H 23/02*** | (2006.01) |

(52) U.S. Cl.

CPC ..... *A61H 15/02* (2013.01); *A61H 23/0263* (2013.01); *A61H 2015/0064* (2013.01); *A61H 2201/0207* (2013.01); *A61H 2201/1215* (2013.01); *A61H 2201/5025* (2013.01)

(58) Field of Classification Search

CPC ..... A61H 15/02; A61H 23/0263; A61H 2015/0064; A61H 2201/0207; A61H 2201/1215; A61H 2201/2025

See application file for complete search history.

(56) References Cited

U.S. PATENT DOCUMENTS

| | | | | |
|---|---|---|---|---|
| 5,413,551 | A * | 5/1995 | Wu | A61H 15/00 601/131 |
| 6,432,071 | B1 * | 8/2002 | Hsieh | A61H 23/0263 601/131 |
| 7,517,324 | B2 * | 4/2009 | Cohen | A61H 7/001 601/135 |
| 9,962,309 | B2 * | 5/2018 | Connors | A61H 1/008 |
| 10,252,116 | B2 * | 4/2019 | Marton | A61H 23/0254 |
| 10,285,899 | B2 * | 5/2019 | Jones | A63B 23/0216 |
| 10,682,252 | B2 * | 6/2020 | Powers | A61F 7/007 |
| 2020/0114220 | A1 * | 4/2020 | Huang | A63B 43/06 |

* cited by examiner

*Primary Examiner* — Steven O Douglas
(74) *Attorney, Agent, or Firm* — Steven Rinehart

(57) ABSTRACT

A spherical manual and electromechanically-operated spherical massage implement which facilitates the even application of pressure to the body tissue of a client during massage therapy, including tendons, ligaments, and muscles (e.g. the gluteus maximus, gluteus medius, and the like). Variations of the invention include vibrating and heating functions, relieve sore and achy muscles, help blood circulation, relieve muscle cramps, loosen tight and knotted muscles, and relieve pressure from the massage therapist's hands.

9 Claims, 7 Drawing Sheets

ELECTROMECHANICAL SPHERICAL MASSAGE IMPLEMENT

FIELD OF THE INVENTION

This invention relates to massage tools, and more particularly relates to massage devices for applying rolling pressure to fascia, muscles, ligaments, tendons and joints.

BACKGROUND

Description of the Related Art

The present invention constitutes an improvement to standard massage tools commonly known and available in the art, including handheld implements. Traditional massage tools known in the art primarily comprise grippable, solid blunt objects for use by massage therapists in deep tissue massage, shiatsu, Bowen therapy, Balinese massage, and the like. With the improvement of efficiency of battery-powered implements and increasing tolerability of mechanical tools being used in massages practices, electromechanically-assisted massage implements are now tenable.

Traditional massage tools are meant to serve the mutual goals of relieving sore and achy muscles, helping blood circulation, relieving muscle cramps, loosening tight and knotted muscles, and relieving pressure from the massage therapist's hands.

Conventionally, these objects are used in pushing and pulling tissue, and comprise a whole series of objects, including objects as simple as a stones to complex handtools with irregularly rounded protrusions for kneading fascia and other connective tissue. These objects usually contact only small surface areas of tissue of several square inches or less, and cannot rapidly be moved across a client's body to apply pressure to multiple situs or simultaneously across larger surface areas on the body.

These tools usually must be lifted and repositioned, and pushed across skin and tissue by the massage therapist is a manner can damage skin and which results in high friction between the tool and tissue, as well as uneven pressure being applied to tissue in the subject area as the object is moved.

None of the tools known in the art comprise rounded, vibrating or heated elements for even applying pressure as needed to proficiently practice certain massage techniques.

SUMMARY

From the foregoing discussion, it should be apparent that a need exists for an multifunction massage implement which overcomes inefficiencies with the prior art.

The present invention has been developed in response to the present state of the art, and in particular, in response to the problems and needs in the art that have not yet been fully solved by currently available apparti.

Accordingly, the present invention has been developed to provide an electromechanical massage implement with vibrating and heating functionality comprising: a first flexible outer hemisphere defining an aperture adapted to receive a faceplate having a first pliable surface, the first pliable surface comprising a plurality of protuberances having planar top surfaces; a second flexible outer hemisphere having a second pliable surface, the second pliable surface comprising a plurality of protuberances having planar top surfaces; a first rigid inner hemisphere adapted to house electromechanical components; a second rigid inner hemisphere adapted to house electromechanical components; a power source comprising a battery; and a motor having an eccentric weight.

The electromechanical massage implement may further comprise a heating element.

The faceplate may comprise three or more depressible buttons for activating one or more of the motor and heating element.

The protuberances may be elongate across a longitudinal axis.

The inner hemispheres may mate one with another on a plane which is orthogonal to the plane upon which the upper and lower hemispheres mate one with another.

The lower hemisphere may comprises a door.

In various embodiments, the motor is affixed to a U-shaped bracket and the U-shaped bracket is affixed to one of the lower hemisphere and an inner hemisphere.

The power supply may be detachable.

A second electromechanical massage implement with vibrating and heating functionality comprising: a first flexible outer hemisphere defining an aperture adapted to receive a faceplate having a first pliable surface, the first pliable surface defining a plurality of grooves running longitudinally on the first pliable surface; a second flexible outer hemisphere having a second pliable surface; a first rigid inner hemisphere adapted to house electromechanical components; a second rigid inner hemisphere adapted to house electromechanical components; a power source comprising a battery; a motor having an eccentric weight; a heating element.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Each hemisphere comprises a pliable and soft plastic or rubber enclosure having a surface forming convex surface functioning to house the motor and also provide massage function by means of the texturing formed on the surface thereof.

Figure 1:
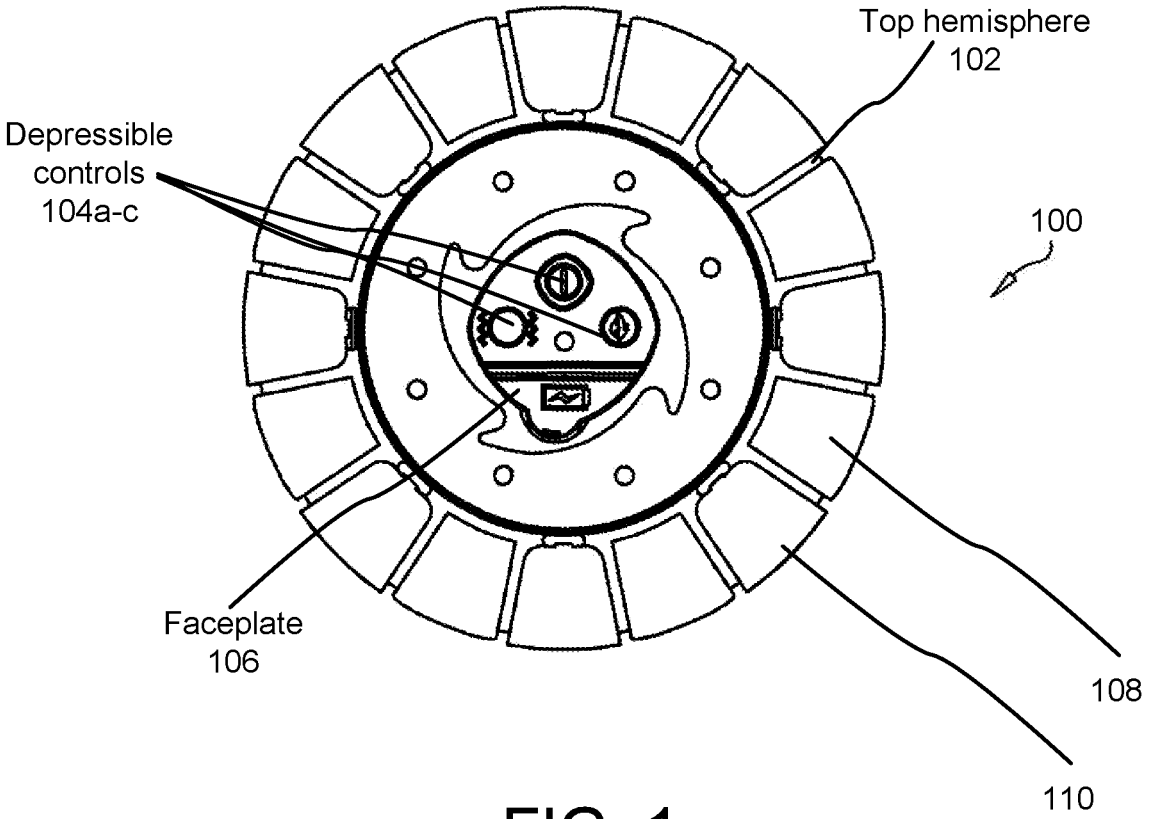
FIG. 1 is a top perspective view of a spherical massage implement 100 in accordance with the present invention.

FIG. 1 is a top perspective view of a spherical massage implement 100 in accordance with the present invention.

The implement 100 comprises a faceplate 106 which inserts into an aperture in the top hemisphere 102*a* of the implement 100 (or outer hemisphere). The faceplate 106 comprise a plurality of depressible controls 104*a-c* which activate to impart function to the implement 100, including vibrating function using an electromechanical motor with an eccentric weight forming therewith housed interiorly to the implement 100. On other embodiments, one or more of the depressible controls 104*a-c* are tactiley activatable to impart heating function to the implement 100 using heating elements housed therewith.

The outer surface of the top hemisphere 102 comprises a plurality of elongated rectangular protuberances 108 (and second protuberances 110) with planer top surfaces. In various embodiments, two of the four corners of these protuberances 108, 110 are rounded off. The protuberances 108 may be positioned around the circumference of the hemisphere 102 in alternative sequence with the second protuberances 110.

Figure 2:
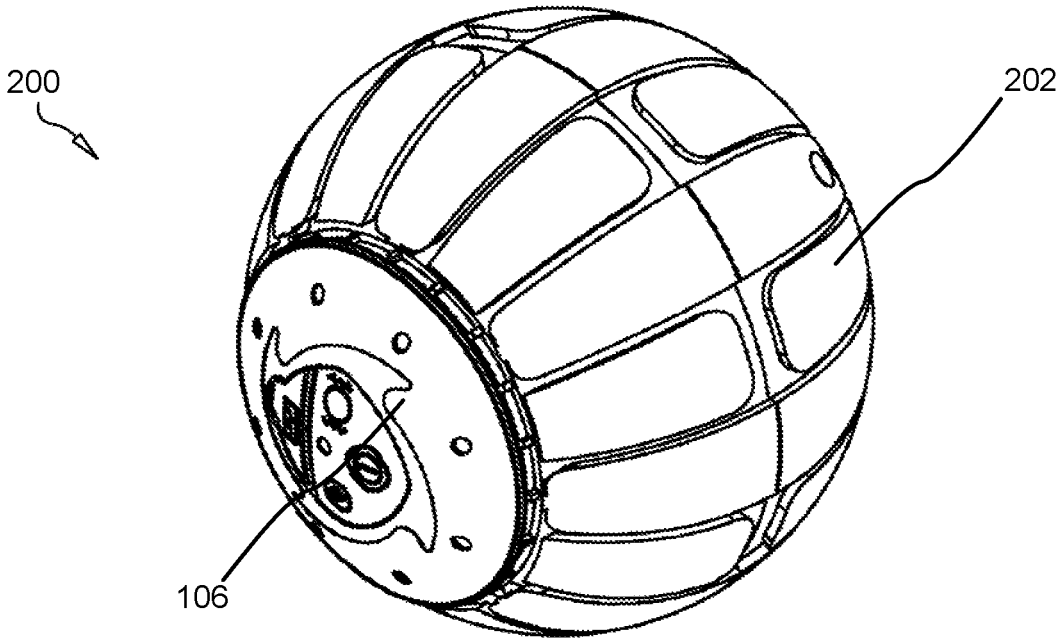
FIG. 2 is a lower, side perspective view of a spherical massage implement 200 in accordance with the present invention.

FIG. 2 is a lower, side perspective view of a spherical massage implement 200 in accordance with the present invention.

As shown, the implement 200 comprises a lower hemisphere 202 which mates with the upper hemisphere 102 using threads, snaps, a friction fit, or through other means. The protuberances 108, 110 on the lower hemisphere 202 may be positioned and dimensioned to meet with protuberances on the upper hemisphere 102 for even engagement of a skin surface. In various embodiments, an elastomeric material is used to form the protuberances 108, 110 with is more flexible and compressible than the materials used to form the remainder of the upper and lower hemispheres 102, 202.

Figure 3A:
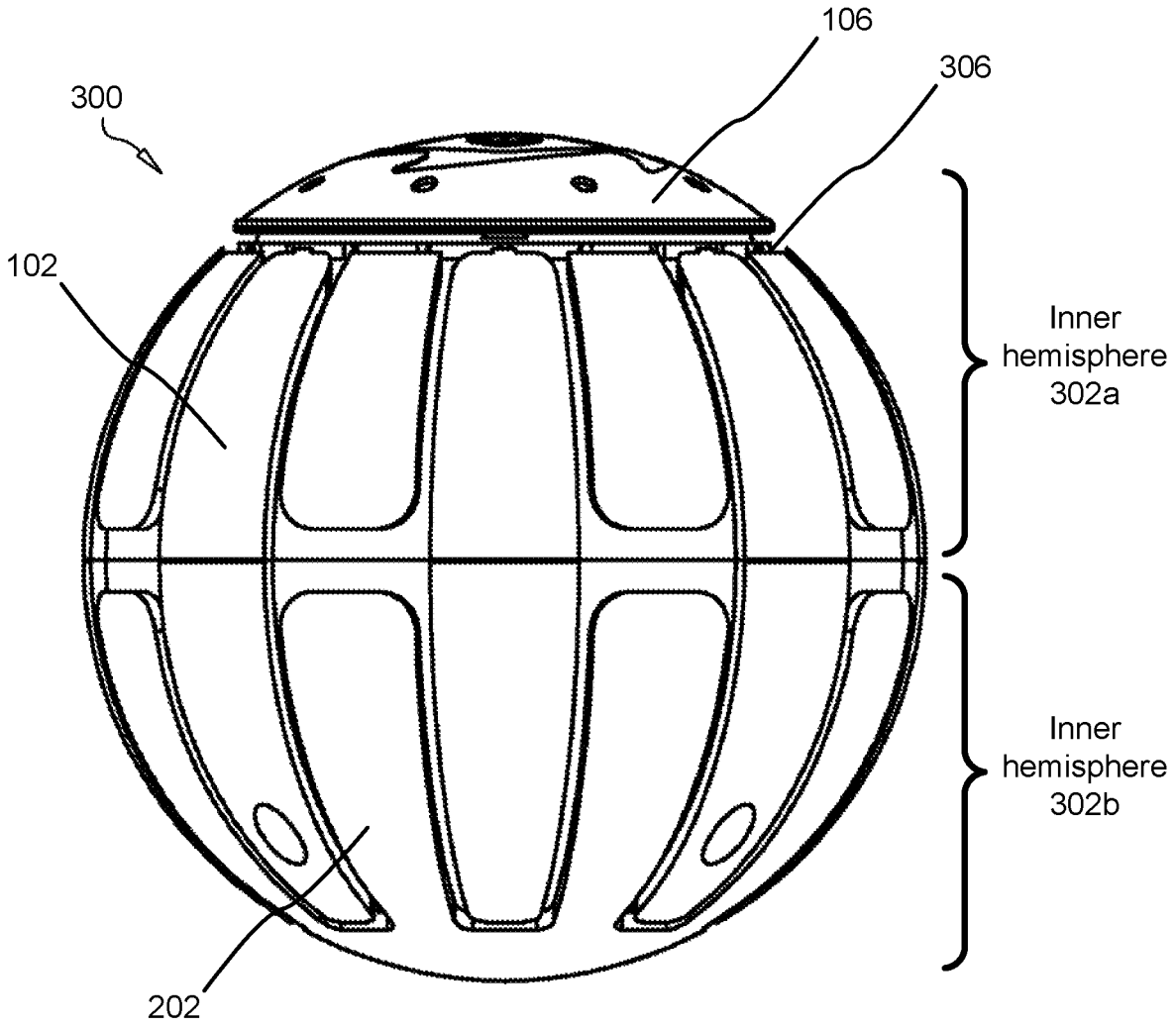
FIG. 3A is a side perspective view of a spherical massage implement 300 in accordance with the present invention.

FIG. 3A is a side perspective view of a spherical massage implement 300 in accordance with the present invention.

As shown, the faceplate 106 is convex and inserts into an open top end 306 (or open top aperture) sized and dimensioned to receive the faceplate 106. The faceplate 106 is affixed, detachably or permanently, to the upper hemisphere 102.

In some embodiments, the implement 300 comprises two inner hemispheres 302*a-b* which position within the upper and lower hemispheres 102, 202 and which affix to internal electromechanical components such as a motor and/or heating element and/or power supply.

Figure 3B:
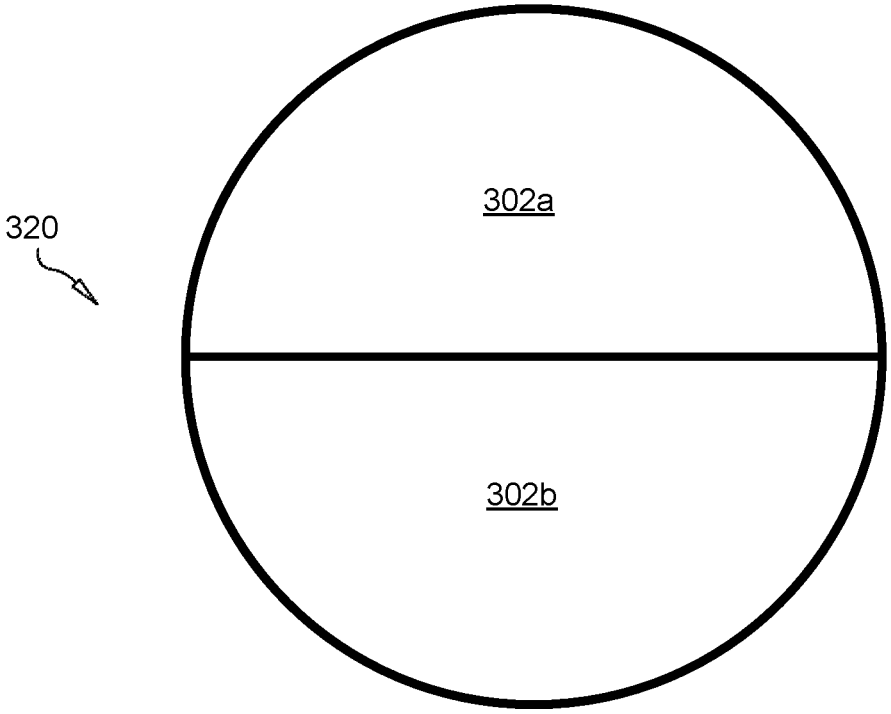
FIG. 3B is a side perspective view of the inner hemispheres of a spherical massage implement 320 in accordance with the present invention.

FIG. 3B is a side perspective view of the inner hemispheres of a spherical massage implement 320 in accordance with the present invention.

The inner hemispheres 302*a-b* may be disposed one above the other as shown.

Figure 3C:
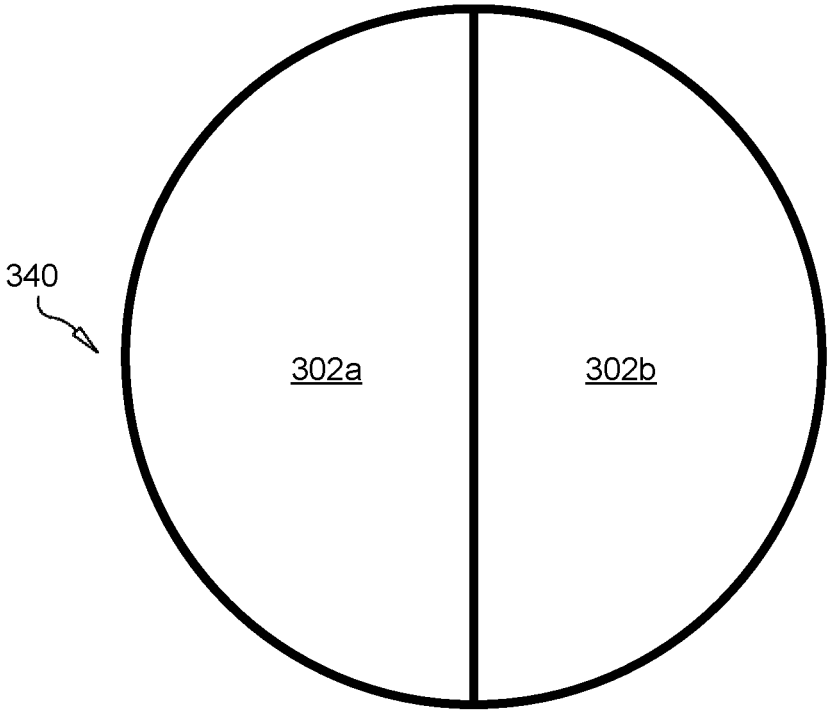
FIG. 3C is a side perspective view of the inner hemispheres of a spherical massage implement 340 in accordance with the present invention.

FIG. 3C is a side perspective view of the inner hemispheres of a spherical massage implement 340 in accordance with the present invention;

The inner hemispheres 302*a-b* may be disposed side-by-side within the implement 300 as shown.

Figure 4:
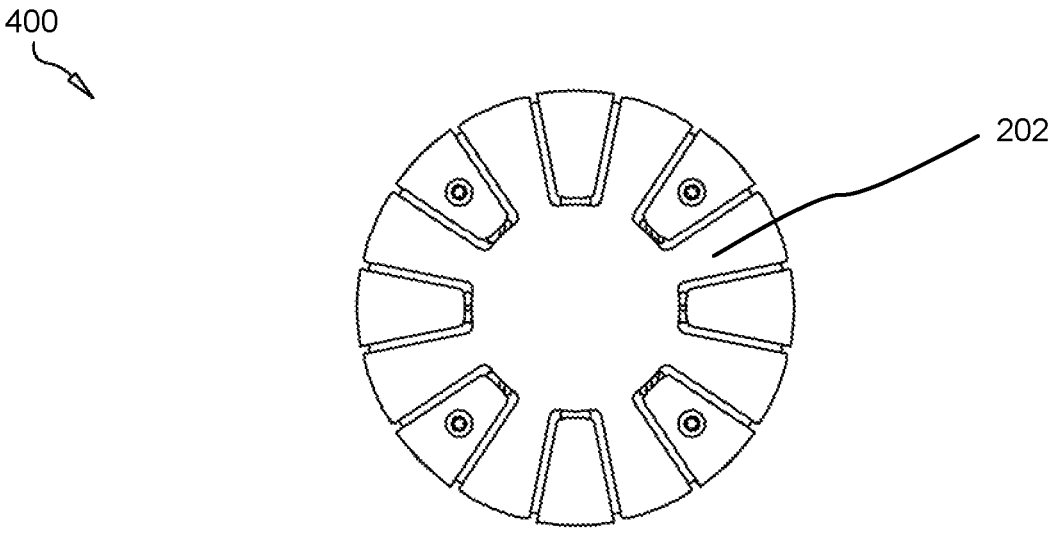
FIG. 4 is a bottom perspective view of a spherical massage implement 400 in accordance with the present invention.

FIG. 4 is a bottom perspective view of a spherical massage implement 400 in accordance with the present invention.

As shown from a lower perspective, there is not faceplate 106 on the lower hemisphere 202 in the shown embodiment.

Figure 5:
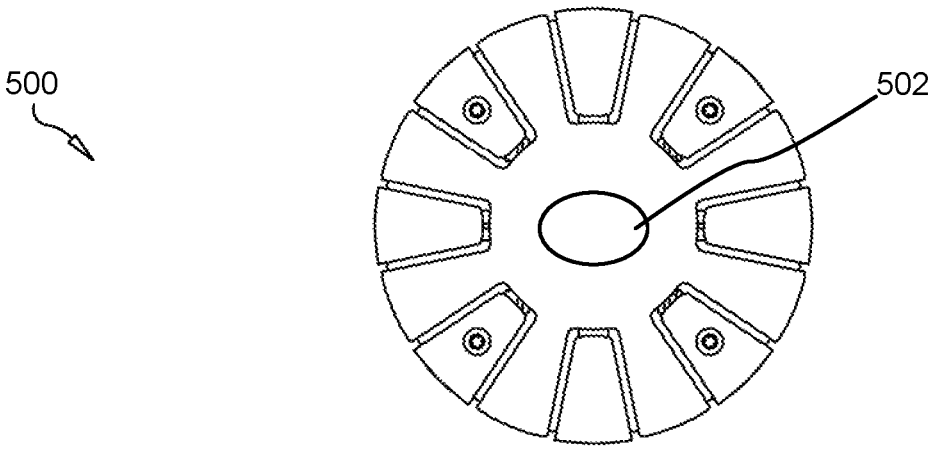
FIG. 5 is a bottom perspective view of a spherical massage implement 500 in accordance with the present invention.

FIG. 5 is a bottom perspective view of a spherical massage implement 500 in accordance with the present invention.

In other embodiments, there is a door 502 on the lower hemisphere 202 which opens using means known to those of skill in the art to allow a power supply to insert in and out of the implement 500.

Figure 6:
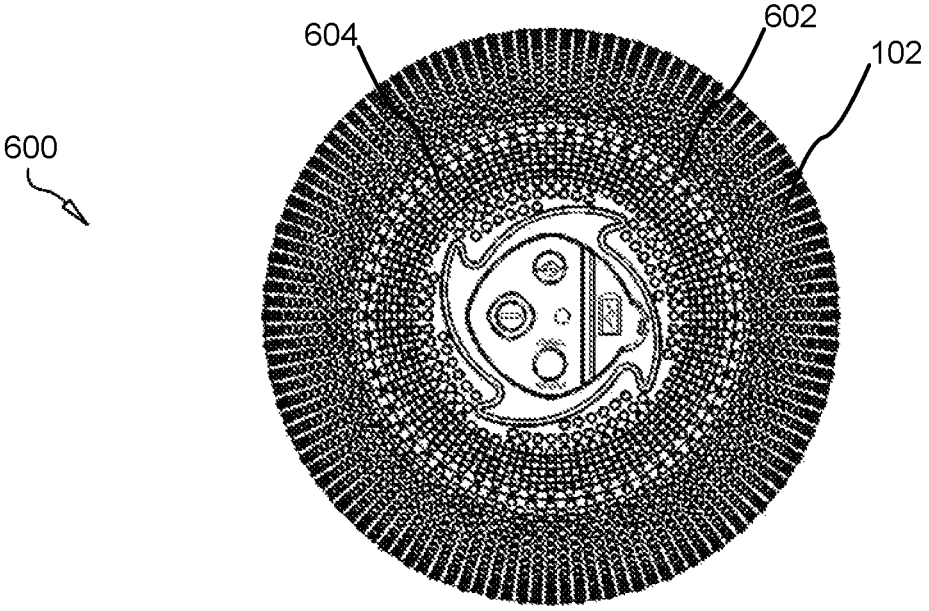
FIG. 6 is a top perspective view of a disassembled spherical massage implement 600 in accordance with the present invention.

FIG. 6 is a top perspective view of a disassembled spherical massage implement 600 in accordance with the present invention.

In various embodiments, longitudinally-running grooves position on the upper hemisphere 102 which run longitudinally downward from the faceplate toward the junction of the upper hemisphere 102 with the lower hemisphere 202.

Figure 7:
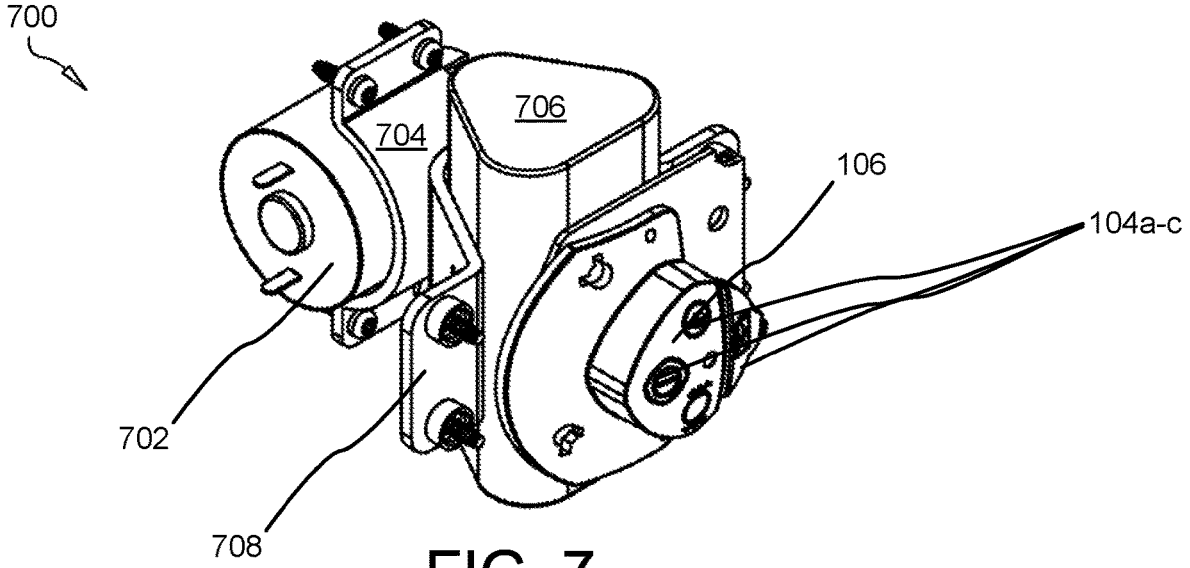
FIG. 7 is a top, side perspective view of the inner electromechanical components 700 of a spherical massage implement in accordance with the present invention.

FIG. 7 is a top, side perspective view of the inner electromechanical components 700 of a spherical massage implement in accordance with the present invention.

The components 700 comprise a power supply 706 affixed to a V-shaped retaining bracket 708, the V-shaped retaining bracket 708 affixed to a U-shaped mounting bracket 702 which is affixed to a motor 702. The motor 702 is activated in response to one of the depressible controls 104 being tactiley-activated by a user.

Figure 8:
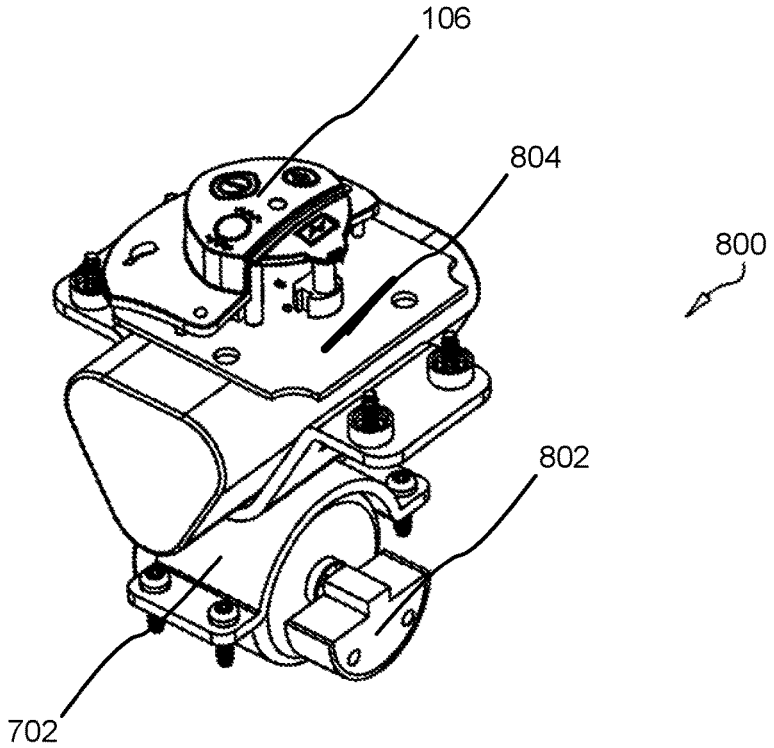
FIG. 8 is a top, side perspective view of the inner electromechanical components 800 of a spherical massage implement in accordance with the present invention.

FIG. 8 is a top, side perspective view of the inner electromechanical components 800 of a spherical massage implement in accordance with the present invention.

In various embodiments, the motor 702 comprises an eccentric weight 802 affixed to a shaft of the motor 702. When the motor is activated and spins after being electromagnetically-induced, the eccentric weight 802 causes the implement 200 to vibrate and imparts vibratory function to the implement 200 and to a patient upon whom the implement 200 is being used.

The components 800 also comprise one or more heating elements 804.

Figure 9:
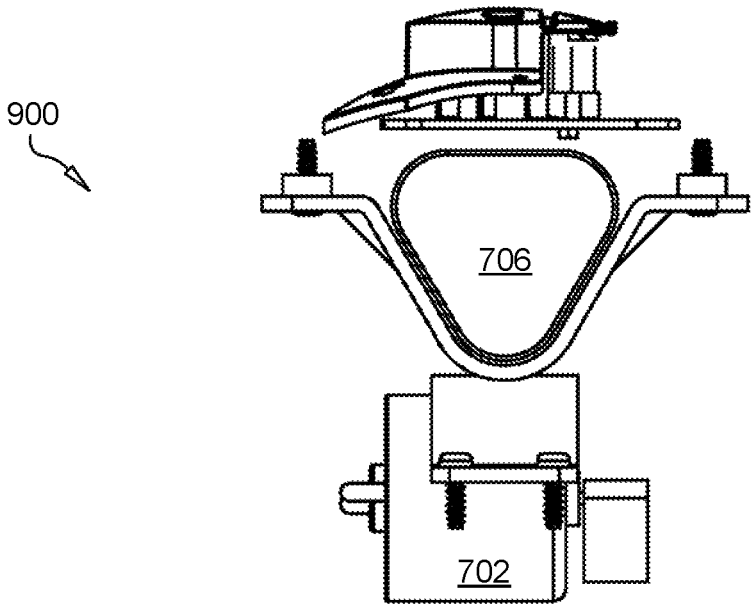
FIG. 9 is a side perspective view of the inner electromechanical components of a spherical massage implement 900 in accordance with the present invention.

FIG. 9 is a side perspective view of the inner electromechanical components of a spherical massage implement 900 in accordance with the present invention.

The power supply 706 is detachable and may be replaced by separating the hemispheres 102, 202 one from another.

Figure 10:
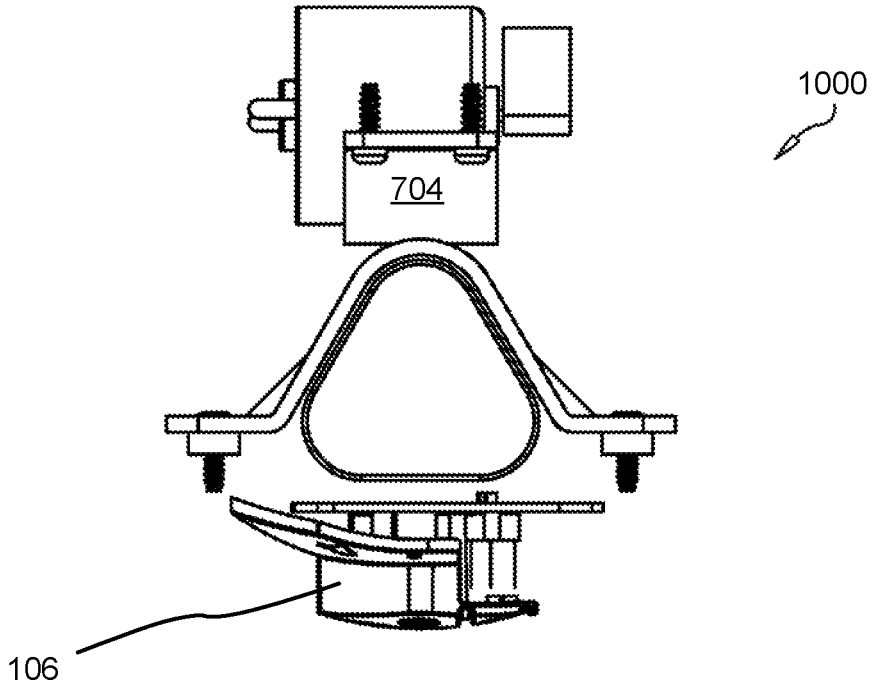
FIG. 10 is a motor of a disassembled spherical massage implement 1000 in accordance with the present invention.

FIG. 10 is a motor of a disassembled spherical massage implement 1000 in accordance with the present invention.

The U-shaped bracket 702 affixes to one of the lower hemisphere 202 and an inner hemisphere 302 using a plurality of screws while the V-shaped bracket 708 affixed to one of the inner hemispheres 302 and the upper hemisphere 102.

It is an object of the present invention to provide a manual and electromechanically-operated spherical massage implement is disclosed which facilitates the even application of pressure to the body tissue of a client during massage therapy, including tendons, ligaments, and muscles (e.g. the gluteus maximus, gluteus medius, sartorius, plantaris, and the like). Variations of the disclosed implement comprise vibrating and heating functions and detachable claws. The disclosed invention relieves sore and achy muscles, helps blood circulation, relieving muscle cramps, loosening tight and knotted muscles, and relieving pressure from the massage therapist's hands.

What is claimed is:

1. An electromechanical massage implement with vibrating and heating functionality comprising:

a first flexible outer hemisphere defining an aperture adapted to receive a faceplate having a first pliable surface, the first pliable surface comprising a plurality of protuberances having planar top surfaces;

a second flexible outer hemisphere having a second pliable surface, the second pliable surface comprising a plurality of protuberances having planar top surfaces;

a first rigid inner hemisphere adapted to house electromechanical components;

a second rigid inner hemisphere adapted to house electromechanical components;

a power source comprising a battery; and a motor having an eccentric weight.

2. The electromechanical massage implement of claim 1, further comprising a heating element.

3. The electromechanical massage implement of claim 2, wherein the faceplate comprises three or more depressible buttons for activating one or more of the motor and the heating element.

4. The electromechanical massage implement of claim 1, wherein the protuberances are elongate across a longitudinal axis.

5. The electromechanical massage implement of claim 1, wherein the inner hemispheres mate one with another on a plane which is orthogonal to the plane upon which the first flexible outer hemisphere and the second flexible outer hemisphere mate one with another.

6. The electromechanical massage implement of claim 1, wherein the second flexible outer hemisphere comprises a door.

7. The electromechanical massage implement of claim 1, wherein the motor is affixed to a U-shaped bracket and the U-shaped bracket is affixed to one of the second flexible outer hemisphere and an inner hemisphere.

8. The electromechanical massage implement of claim 1, wherein the power source is detachable.

9. An electromechanical massage implement with vibrating and heating functionality comprising:

a first flexible outer hemisphere defining an aperture adapted to receive a faceplate having a first pliable surface, the first pliable surface defining a plurality of grooves running longitudinally on the first pliable surface;

a second flexible outer hemisphere having a second pliable surface;

a first rigid inner hemisphere adapted to house electromechanical components;

a second rigid inner hemisphere adapted to house electromechanical components;

a power source comprising a battery;

a motor having an eccentric weight;

a heating element.

* * * * *